US009908249B2

(12) United States Patent
Ackermans et al.

(10) Patent No.: US 9,908,249 B2
(45) Date of Patent: Mar. 6, 2018

(54) HAIR CLIPPING DEVICE

(71) Applicant: KONINKLIJKE PHILIPS N.V., Eindhoven (NL)

(72) Inventors: Paul Anton Josef Ackermans, Eindhoven (NL); Petrus Henricus De Leeuw, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 203 days.

(21) Appl. No.: 14/422,272

(22) PCT Filed: Aug. 29, 2013

(86) PCT No.: PCT/IB2013/058099

§ 371 (c)(1),
(2) Date: Feb. 18, 2015

(87) PCT Pub. No.: WO2014/037854

PCT Pub. Date: Mar. 13, 2014

(65) Prior Publication Data

US 2015/0217463 A1 Aug. 6, 2015

Related U.S. Application Data

(60) Provisional application No. 61/698,771, filed on Sep. 10, 2012.

(51) Int. Cl.
*B26B 19/00* (2006.01)
*B26B 19/14* (2006.01)
(Continued)

(52) U.S. Cl.
CPC ..... *B26B 19/14* (2013.01); *B26B 19/06* (2013.01); *B26B 19/12* (2013.01); *B26B 19/26* (2013.01)

(58) Field of Classification Search
CPC ..... B26B 19/12; B26B 19/04; B26B 19/06; B26B 19/102; B26B 19/26
(Continued)

(56) References Cited

U.S. PATENT DOCUMENTS 430,070 A * 6/1890 Cogswell ..... B26B 19/24 30/207
558,973 A * 4/1896 Milliken ..... B26B 19/06 30/197
(Continued)

FOREIGN PATENT DOCUMENTS

DE 1194289 B 6/1965
DE 3403761 A1 8/1985
(Continued)

*Primary Examiner* — Andrea Wellington
*Assistant Examiner* — Samuel A Davies

(57) ABSTRACT

The present invention relates to a hair clipping device, comprising: —a housing (12); —a cutting assembly (14) which is arranged on one end of said housing (12) and comprises a stationary blade element (22) with a circumferentially arranged toothed cutting edge (26) surrounding the stationary blade element (22) and a moveable blade element (24) with a circumferentially arranged second cutting edge (28) surrounding the moveable blade element (24), wherein the stationary blade element (22) and the moveable blade element (24) are arranged substantially parallel to each other; and —a motor (34) for driving a drive shaft (36) in a rotatory manner; wherein the drive shaft (36) is coupled to the moveable blade element (24) via an eccentric coupling mechanism (38) that translates a rotatory movement of the drive shaft (36) into an eccentric movement of the moveable blade element (24).

20 Claims, 6 Drawing Sheets

(51) Int. Cl.
*B26B 19/06* (2006.01)
*B26B 19/12* (2006.01)
*B26B 19/26* (2006.01)

(58) Field of Classification Search
USPC ..... 30/197, 204, 43.4–43.92
See application file for complete search history.

(56) References Cited

U.S. PATENT DOCUMENTS

| | | | | | |
|---|---|---|---|---|---|
| 2,077,806 | A | | 4/1937 | Muros | |
| 2,081,366 | A | * | 5/1937 | Muros | B26B 19/06 30/43.3 |
| 2,102,594 | A | * | 12/1937 | Hill | B26B 19/12 30/206 |
| 2,265,305 | A | | 6/1938 | Nyhagen | |
| 2,331,417 | A | * | 10/1943 | Naegeli | B26B 21/00 30/145 |
| 3,132,424 | A | * | 5/1964 | Kirkland | B26B 19/06 30/197 |
| 3,507,040 | A | | 4/1970 | MacCarthy | |
| 5,367,772 | A | | 11/1994 | Ogawa | |
| 5,692,303 | A | * | 12/1997 | Garenfeld | B26B 19/14 30/43.9 |
| 8,132,540 | B1 | | 3/2012 | Strebeigh | |
| 2005/0055834 | A1 | | 3/2005 | Cheah | |
| 2005/0198824 | A1 | | 9/2005 | White | |
| 2008/0040927 | A1 | | 2/2008 | Lau | |
| 2012/0110855 | A1 | | 5/2012 | Allen, Sr. | |

FOREIGN PATENT DOCUMENTS

| | | | |
|---|---|---|---|
| DE | 29824159 | U1 | 12/2000 |
| EP | 0325326 | A1 | 7/1989 |
| JP | 6060878 | A | 4/1985 |
| WO | 9529042 | A1 | 11/1995 |
| WO | 9818604 | A1 | 5/1998 |

* cited by examiner

HAIR CLIPPING DEVICE

This application is the U.S. National Phase application under 35 U.S.C. § 371 of International Application No. PCT/IB2013/058099, filed on Aug. 29, 2013, which claims the benefit of U.S. Provisional Application No. 61/698,771 filed on Sep. 10, 2012. These applications are hereby incorporated by reference herein.

FIELD OF THE INVENTION

The present invention relates to a hair clipping device. Further, the present invention relates to a cutting assembly for use in such a hair clipping device.

BACKGROUND OF THE INVENTION

Electric hair cutting appliances are generally known and include trimmers, clippers and shavers whether powered by main supplied electricity or batteries. Such devices are generally used to trim body hair, in particular facial and head hair to allow a person to have a well-groomed appearance.

Conventional hair cutting devices comprise a main body forming an elongated housing having a front or cutting end and an opposite handle end. A cutting assembly is disposed at the cutting end. Most of the cutting blade assemblies known in the art comprise a stationary blade element and a moveable blade element which moves in a reciprocal, translatory manner relative to the stationary blade element. The cutting blade assembly itself extends from the cutting end and is usually fixed in a single position relative to the main body of the hair clipper, such that the orientation of the cutting blade assembly is determined by a user orientating the main body of the device.

Hair clippers of the kind mentioned above are usually used to trim beards and therefore have a rather large cutting blade assembly with large blade elements. Such a device is, for example, known from U.S. Pat. No. 5,367,772 A. As an additional feature, this device allows an adjustment of the position of the moveable cutting blade with respect to the stationary cutting blade in order to selectively adapt the distance between these blades to accomplish a plurality of different hair cut lengths by using one and the same device. However, the type of trimmers known from U.S. Pat. No. 5,367,772 A are only suited for trimming large and rough hair contours, such as for trimming the whole beard or parts of the head hair. Due to their large cutting blade assemblies, fine details are really difficult to cut with these kind of hair trimmers.

Other types of hair trimmers also exist that allow to cut fine details into the hair or to allow hair cutting at very sensitive or tiny body locations such as in the nostrils or in the ears. A hair trimming device of this type is, for example, known from WO 98/18604 A. However, such a trimmer would not be useful to cut fine and fancy-shaped contours into a beard as this is nowadays becoming more and more fashionable. Very tiny trimmers with tiny cutting blade assemblies, as they are also known in the art, can be used to cut such fancy and fine details into the beard. An example of this type of hair trimmer is known from US 2012/0110855 A1. It relates to a hair trimmer that is capable of making delicate and precise cuts and designs in ones hair. A small razor pad is used that is capable of getting into tight complicated areas of the face easier. As the trimmer has more agility to move around curves and indentations on the face, parts of the beard, mustache and the hair around the ear can be kept intact. On the other hand, this device is certainly not useful to cut large and rough contours in a fast and comfortable way, since every tremble of the user's hand will result in a non-straight contour.

This means for the user that he/she needs to have several different types of hair trimmers, for each kind of body hair and each type of contour he/she wants to cut. It is evident that this problem of having to choose between different types of trimmer elements or even between different types of trimmers and shavers (small and coarse trimmers) is not comfortable for a user.

SUMMARY OF THE INVENTION

Therefore, it is an object of the present invention to provide a hair clipping device that overcomes the problem of having to make a choice between small and coarse trimmer elements. A hair clipping device shall be provided that is able to cut both, fine and coarse contours. Furthermore, it is an object to provide a corresponding cutting blade assembly for such a hair clipper.

In a first aspect of the present invention, a hair clipping device is presented that comprises:

- a housing;
- a cutting assembly which is arranged on one end of said housing and comprises a stationary blade element with a circumferentially arranged toothed cutting edge surrounding the stationary blade element and a moveable blade element with a circumferentially arranged second cutting edge surrounding the moveable blade element, wherein the stationary blade element and the moveable blade element are arranged substantially parallel to each other; and
- a motor for driving a drive shaft in a rotatory manner;

wherein the drive shaft is coupled to the moveable blade element via an eccentric coupling mechanism that translates a rotatory movement of the drive shaft into an eccentric movement of the moveable blade element.

In a further aspect of the present invention, a cutting assembly for use in such a hair clipping device is presented that comprises:

- a stationary blade element with a circumferentially arranged toothed cutting edge surrounding the stationary blade element;
- a moveable blade element with a circumferentially arranged second cutting edge surrounding the moveable blade element; and
- an eccentric coupling mechanism;

wherein the stationary blade element and the moveable blade element are arranged substantially parallel to each other, wherein the eccentric coupling mechanism is connected to the moveable blade element and can be coupled to a rotatory driven drive shaft, and wherein the eccentric coupling mechanism is further adapted to translate a rotatory movement of the drive shaft into an eccentric movement of the moveable blade element.

Preferred embodiments of the invention are defined in the dependent claims. It shall be understood that the claimed cutting assembly has similar and/or identical preferred embodiments as the claimed hair clipping device and as defined in the dependent claims.

One of the central points of the hair clipping device proposed herein is the design of the cutting edges. The cutting edges are designed as circumferential cutting edges. In contrast to conventional hair clipping devices which make use of two linear/straight cutting edges that move relative to each other in a parallel manner, the cutting edges of the hair clipping device according to the present invention are arranged over the entire outer circumference of the cutting blade elements, i.e. surrounding the cutting assembly. The two cutting edges (the toothed cutting edge of the stationary blade element and the second cutting edge of the moveable blade element) are therefore not only arranged on one end of the cutting assembly, but proceed over the entire lateral periphery of the cutting assembly. The hair clipping device may thus be turned around its central axis by 360 degrees and each section of the two cutting edges along this 360° turn may be used for hair trimming. In other words, hair may be cut along the entire periphery/circumference of the cutting assembly and not simply along a straight line on one end or side of the cutting assembly (as this is the case in most of the prior art hair clipping devices).

An even more important point relates to the manner of driving the moveable blade element with respect to the stationary blade element. According to the present invention, the moveable blade element performs an eccentric movement relative to the stationary blade element. This is realized by a motor for driving a drive shaft in a rotatory manner (similar as in other hair clipping devices), wherein the drive shaft is coupled to the moveable blade element via an eccentric coupling mechanism that translates a rotatory movement of the drive shaft into an eccentric movement of the moveable blade. The stationary blade element remains still (i.e. does not move). The eccentric coupling mechanism used according to the present invention is a mechanical mechanism that may also be denoted as eccentric gearing or eccentric movement coupling.

Similar as in conventional hair clipping devices the two blade elements, the stationary blade element and the moveable blade element, are arranged substantially or even exactly parallel to each other and resiliently biased against each other. This bias or pre-load serves for an efficient hair cutting performance by providing a so-called teeth pressure (pressure with which the two cutting edges are pressed against each other) and obviates an unwanted pulling effect of the hair.

In contrast to a straight, linear and parallel relative movement of the two cutting edges as in conventional hair trimmers, the moveable blade element makes a small eccentric movement relative to the stationary blade element. This movement is the same at all sides of the blade element around the entire circumference of the cutting assembly. As the movement is the same at all sides of the cutting assembly, hair may be cut/trimmed along the entire circumference of the cutting assembly, i.e. by orienting the blade elements in any arbitrary orientation relative to the skin. Even more important is that this technical idea of eccentrically driving the moveable blade element relative to the stationary blade element permits to design the blade elements in any arbitrary shape. The contours of the blade elements may thus have a variety of different form.

Independent of the form/shape of the blade elements, it is preferred that the stationary blade element and the moveable blade element have substantially the same form. This ensures that the cutting performance is the same at all sides along the periphery of the cutting assembly.

Since the moveable blade element eccentrically moves relative to the stationary blade element and therefore during its movement covers a larger area than its own surface area, it is furthermore preferred that the stationary blade element is larger than the moveable blade element, i.e. the stationary blade element preferably has a larger dimension than the moveable blade element.

Since different shapes of the blade elements may be realized, and since both cutting edges are circumferentially arranged, it is possible to design one side of the blade elements with a straight, linear cutting edge and another side of the blade elements with a curved cutting edge. As the blade elements have 360°—surrounding cutting edges, even more than two differently shaped sections may be realized at the outer periphery of the cutting assembly. These differently shaped sections may be used for different kinds of hair trimming appliances. One section could be used to cut very coarse and rough contours, while another section of the periphery of the cutting assembly could be used for very fine and detailed cutting contours. When having to switch from a very coarse cutting contour to a very fine cutting contour, the user just has to turn the hair clipping device and use the finer, more curved section of the cutting blades.

The hair clipping device according to the present invention therefore allows to cut both fine and coarse hair contours with one and the same device.

Preferably, the eccentric movement of the moveable blade element is an eccentric translational movement. The moveable blade element moves in a translational (translatory) eccentric manner relative to the stationary blade element. This means that every tooth of the moveable blade follows the same eccentric trajectory and that each tooth has at the same point in time the same velocity. The movement of the moveable blade as well of each of the teeth is however still an eccentric movement. A translational movement in the sense of the present invention is a translation of the moveable blade element with respect to the stationary blade element. In technical terms this means that a direction of a connecting line between two arbitrary points A and B of the moveable blade element is constant. The velocity vectors at one point in time is the same in both points A and B, ($v_{A(t_0)}=v_{B(t_0)}$) whereas the velocity vector at points A and B at another point in time $t_1$ does not have to be the same as at $t_0$ (this means ($v_{A(t_1)}=v_{B(t_1)}$); but $v_{A(t_0)}$ does not have to be equal to $v_{A(t_1)}$).

According to an embodiment of the present invention, the stationary blade element and the moveable blade element have a drop-shaped form. In other words, the cutting assembly has in a top view the shape/contour of a drop. Such a drop-shaped form combines a fine shape at the tip of the drop with a long shape at the sides of the drop. The long side of the circumferentially arranged cutting edge may thus be used for cutting rough and straight-lined contours, while the tip of the drop-shaped cutting edges is suited for cutting fine details and thin contours. The tip of the drop can be used to cut very fine and fancy forms into a beard, while the straight section of the cutting blade may be used to trim the beard completely. Even though such a drop-shaped form of the blade elements is advantageous, it is to be noted that also other shapes of the blade elements are possible without departing from the present invention.

According to an embodiment of the present invention, the stationary blade element and the moveable blade element have a planar, two-dimensional form. Both may for example have a planar drop-shaped form. The stationary blade element and the moveable blade element are in this case arranged parallel to each other into parallel planes and define between each other a cutting plane along which they are resiliently biased against each other. In such a planar design the circumferentially arranged toothed cutting edge of the stationary blade element is arranged in one common planar plane. The circumferentially arranged second cutting edge of the moveable cutting blade element is also arranged in a planar plane that is parallel to the toothed cutting edge of the stationary blade element.

As already mentioned above, the eccentric movement of the moveable blade element relative to the stationary blade element permits to design the two blade elements in any arbitrary shape, while still being able to cut around the entire circumference of the cutting blade elements (as long as the moveable cutting blade element and the stationary cutting blade element have a similar or the same shape).

According to a further embodiment, the circumferentially arranged toothed cutting edge has a first straight-lined segment and a first curved segment, the circumferentially arranged second cutting edge has a second straight-lined segment and a second curved segment, wherein the first straight-lined segment is arranged substantially parallel to the second straight-lined segment, and wherein the first curved segment is arranged substantially parallel to the second curved segment.

The first and the second straight-lined segment together build a first straight-lined part of the cutting edge and the first and second curve segment together build a first curved part of the cutting edge. It is to be noted that the terms "first" and "second" do not imply a quantity, but are rather used to differentiate between the different segments. The straight-lined cutting edge may be used for trimming coarse and straight hair parts, while the curved part of the cutting edge may be used for cutting fine, round and/or complicated hair contours. As both cutting edge parts are arranged at the circumference of the two cutting blade elements the user just has to slightly turn the device into the desired orientation in order to change between coarse and fine hair cutting contours.

According to a further embodiment, the circumferentially arranged toothed cutting edge further has a third straight-lined segment and a third curved segment, wherein the circumferentially arranged second cutting edge has a fourth straight-lined segment and a fourth curved segment, wherein the third straight-lined segment is arranged substantially parallel to the fourth straight-lined segment, and wherein the third curved segment is arranged substantially parallel to the fourth curved segment.

The cutting assembly may thus not only have one straight-lined cutting edge, but two or more. Similarly, the cutting assembly may also have two or more curved cutting edge segments.

According to the above-mentioned embodiment, it is especially preferred that the first straight-lined segment has a different length than the third straight-lined segment, the second straight-lined segment has a different length than the fourth straight-lined segment, the first curved segment has a different arc length than the third curved segment, and the second curved segment has a different arc length than the fourth curved segment.

In this case the user may even choose between two differently sized straight-lined cutting edges as well as between two differently bent curved cutting edges. Of course, the user may also use the intersections between the different cutting edges for hair trimming. It shall be noted again that this is only possible due to the eccentric movement of the moveable blade element relative to the stationary blade element and the circumferentially arranged cutting edges. In conventional hair clipping devices, such differently shaped cutting edges would not be possible to accomplish, since most of the prior art devices only use two straight-lined cutting blades that reciprocate relative to each other in a parallel manner.

According to a further embodiment of the present invention, the drive shaft extends along a first direction, wherein the first straight-lined segment, the third straight-lined segment, the first curved segment and the third curved segment are arranged in a first blade plane, which is oriented perpendicular to the first direction, and wherein the second straight-lined segment, the fourth straight-lined segment, the second curved segment and the fourth curved segment are arranged in a second blade plane, which is also oriented perpendicular to the first direction as well.

In this embodiment the drive shaft is oriented perpendicular to the cutting plane, i.e. perpendicular to the first blade plane and the second blade plane. All differently curved segments that are arranged on the periphery of the stationary blade element are arranged in the common first blade plane. In other words, the stationary blade element has according to this embodiment a two-dimensional, planar form. Similarly, also the moveable blade element has according to this embodiment a two-dimensional, planar form with each section of the second cutting edge lying in the same second blade plane.

According to a further embodiment, the second cutting edge surrounding the moveable blade element is a toothed cutting edge. Accordingly, not only the cutting edge of the stationary blade element is toothed, but also the cutting edge of the moveable blade element. The hair clipping device therefore comprises two rows of teeth. This especially increases the quality of hair cutting performance. Alternative, the cutting edge of the moveable blade element may also be a straight, non-toothed cutting edge. Experiments of the inventors have shown that this also leads to a comparably good hair cutting quality.

According to a still further embodiment of the present invention, the stationary blade element and the moveable blade element have a non-planar, three-dimensional form. Due to the special construction of the trimmer with an eccentrically driven moveable blade element, almost every shape of the trimmer blade elements can be realized. Therefore, it is also possible to design the stationary and the moveable blade elements as truly three-dimensional blade elements, while still having circumferentially arranged cutting edges around the periphery of each blade element.

A three-dimensional form even more facilitates to cut hair in confined and complex-shaped areas of the face, the head or other parts of the body. The hair clipping device could also be designed as a hair clipping device for women, for example a hair clipping device that facilitates hair clipping around the bikini line.

In one embodiment, the three-dimensionally shaped blade elements, i.e. the stationary blade element and the moveable blade element, may each comprise at least one spherically curved plane element. In other words, small elements of a sphere can be formed into the blade elements, while it is still possible to trim the hairs with all sides of the cutting assembly due to the above-explained eccentric circular movement of the moveable blade element. When integrating such spherically curved plane elements into the blade elements, it is only important that the at least one spherically curved plane element of the stationary blade element and the at least one spherically curved plane element of the moveable blade element have an identical radius of curvature. Otherwise, a parallel guiding of the moveable blade element relative to the stationary blade element would not be possible during the above-described eccentric movement. Therefore, it is preferred that the radius of curvature of both blade elements is equal and/or constant over the whole surface area.

BRIEF DESCRIPTION OF THE DRAWINGS

These and other aspects of the invention will be apparent from and elucidated with reference to the embodiment(s) described hereinafter. In the following drawings.

DETAILED DESCRIPTION OF THE DRAWINGS

Figure 1:
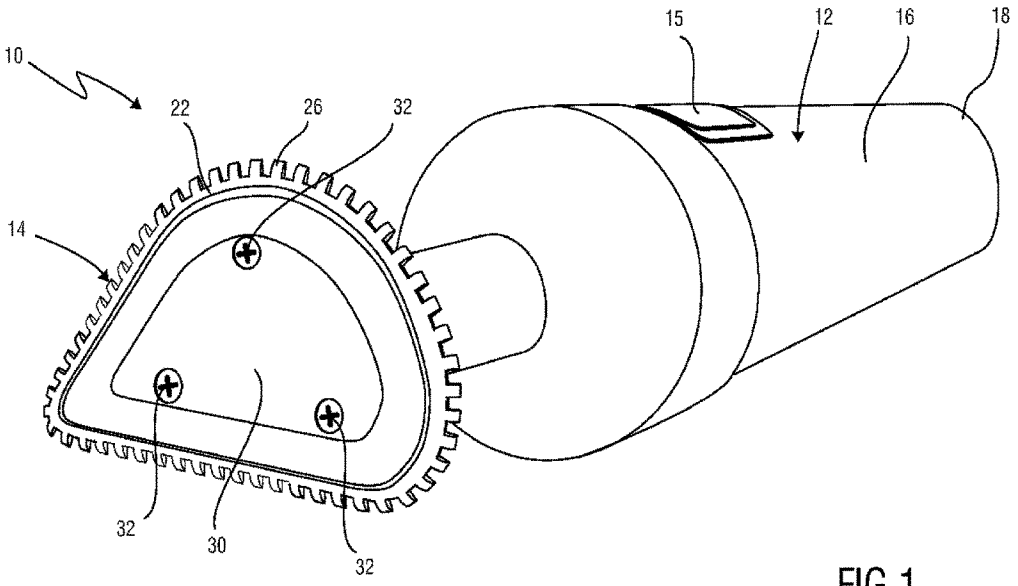
FIG. 1 shows a first embodiment of a hair clipping device according to the present invention in a perspective view, FIG. 2 schematically shows a side view of the hair clipping device according to the first embodiment.
Figure 2:
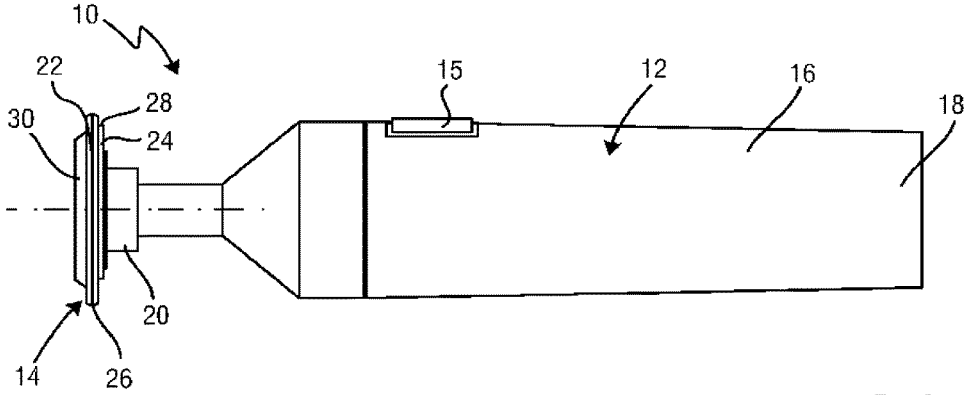

FIGS. 1 and 2 illustrate the principle design of a hair clipping device according to the present invention in a perspective view (FIG. 1) and a schematical side view (FIG. 2). The hair clipping device is therein in its entirety denoted with reference numeral 10. The hair clipping device 10 comprises a housing 12 which serves as a support structure for a cutting assembly 14. The housing 12 has an elongated body that comprises a handle 16 at its rare end 18. The housing 12 has a slim body that resembles the body of a manual razor/shaver. A control button 15 may also be integrated into the housing 12. This control button 15 may either be a simple on/off button, but could also be used to adjust the driving speed of the device 10 or any other parameter. It is to be noted that also other housing arrangements and designs are envisaged without leaving the scope of the invention. Instead of a control button, the housing may also include any other type of adjustor handle to control the device, such as e.g. a so-called zoo-wheel that is similar to the one known from EP 0 325 326 B1. A display may of course also be provided.

The cutting assembly is arranged on a front end 20 of the housing 12. The cutting assembly 14 may either be permanently fixed or releasably attached to the housing 12 in order to being able to change the cutting assembly 14. A releasable connection of the cutting assembly 14 to the housing 12 is especially advantageous as it increases the cleanability of the cutting assembly 14 and thus improves the user friendliness.

The cutting assembly 14 includes a stationary blade element 22 and a moveable blade element 24 arranged parallel thereto. The moveable blade element 24 is displaceable mounted on an upper surface of the stationary blade element 22 which upper surface faces substantially towards the inner side of the housing 12. The stationary blade element 22 comprises a toothed cutting edge 26 with an array of cutting teeth. The stationary blade element 22 is also denoted as guard or comb 22. Different than in conventionally hair clipping devices, the toothed cutting edge 26 of the stationary blade element 22 is not a simple straight-lined cutting edge but circumferentially arranged around the stationary blade element 22, i.e. surrounding the stationary blade element 22.

Figure 3:
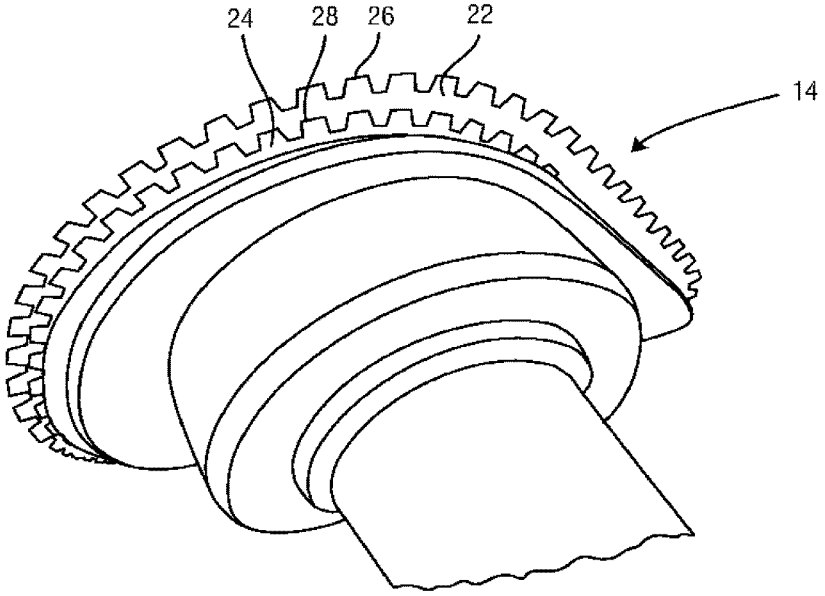
FIG. 3 shows an enlarged view of a cutting assembly of the hair clipping device according to the first embodiment, FIG. 4 schematically illustrates the constructive technical details of the cutting assembly according to the first embodiment, FIG. 5 schematically illustrates the driving principle of the hair clipping device according to the present invention, FIG. 6 schematically shows a second embodiment of the cutting assembly of the hair clipping device according to the present invention in a perspective view (FIG. 6*a*) and a schematic view (FIG. 6*b*) from below.

As it may be seen in FIG. 1, the teeth of the toothed cutting edge 26 are arranged over the entire periphery of the stationary blade element 22. Similar as the stationary blade element 22, the moveable blade element 24 also comprises a circumferentially arranged second cutting edge 28 that surrounds the moveable blade element 24. The moveable blade element 24 is also denoted as "knife". It can be seen in the enlarged view illustrated in FIG. 3. The second cutting edge 28 may also be designed as a toothed cutting edge with an array of teeth. However, it has to be noted that this is not a mandatory feature. The cutting edge 28 of the moveable blade element 24 may also be designed as a continuous sharp edge (without teeth).

A covering plate 30 is arranged parallel to the two blade elements 22, 24 at the end of the cutting assembly 14. The covering plate 30, the stationary blade element 22 and the moveable blade element 24 are preferably mounted together by three screws 32. It is evident that also other fixing elements may be used. In order to receive a good cutting performance, the moveable blade element 24 and the stationary blade element 22 are actively pressed against each other to receive a so-called teeth pressure.

Figure 4:
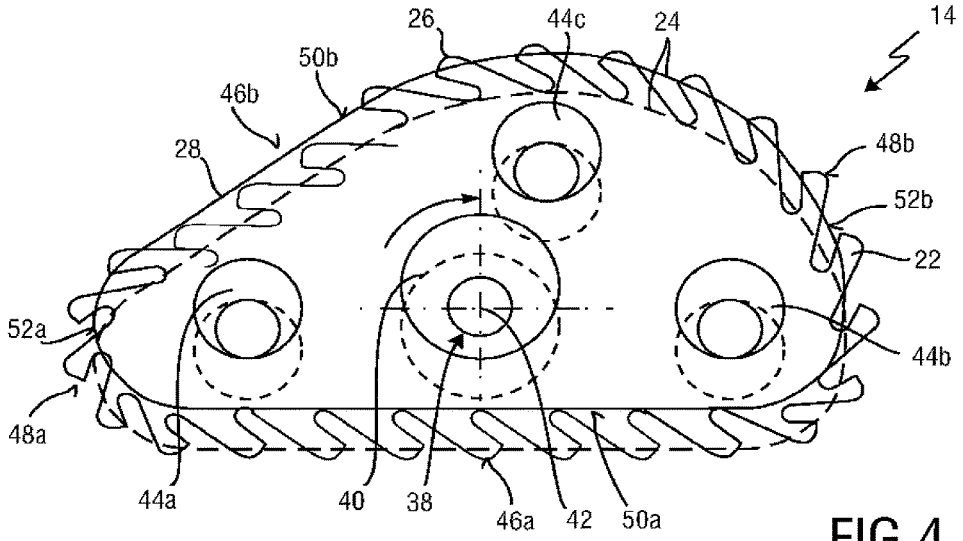
Figure 5:
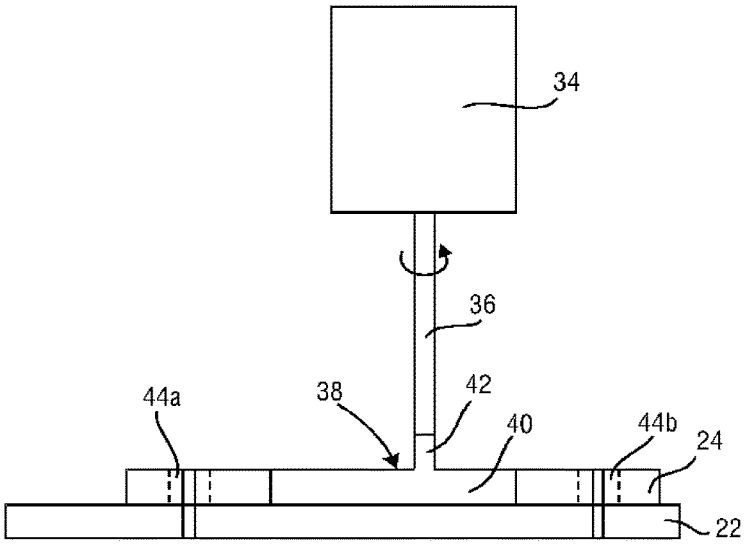

One of the main differences to common hair clipping devices relies in the completely new driving mechanism that is used according to the present invention. The technical principle of this driving mechanism becomes best apparent from FIGS. 4 and 5. As it is depicted in FIG. 4, the moveable blade element 24 during operation performs an eccentric movement relative to the stationary blade element 22 (i.e. the cutting edges of the two blades do not move in a linear fashion parallel to each other as this is the case in most of the prior art devices). This eccentric movement of the moveable blade element 24 is realized as follows: During operation a motor 34 drives a shaft 36 (denoted as drive shaft 36) in a rotatory manner. As shown in FIG. 5, the drive shaft 36 is coupled to the moveable blade element 24 via an eccentric coupling mechanism 38. This eccentric coupling mechanism has the features of an eccentric gearing. It translates the rotatory movement of the drive shaft 36 into an eccentric movement of the moveable blade element 24.

The eccentric coupling mechanism 38 includes an eccentric element 40 (denoted as eccentric 40) that has a pin 42 that is coupled with the drive shaft 36. The pin 42 is eccentrically arranged with respect to the axis of symmetry of the eccentric 40. The eccentric 40 itself is preferably designed as a circular plate that is pivot-mounted within the moveable blade element 24. Three guiding bearings 44*a-c* are additionally provided to guide the eccentric movement of the moveable blade element 24 relative to the stationary blade element 26. As it is depicted in FIG. 4, the rotary movement of the drive shaft 36 causes an eccentric circular movement of the moveable blade element 24 relative to the stationary blade element 26. Due to the guiding bearings 44*a-c*, this eccentric circular movement is a translational movement. The solid lines in FIG. 4 illustrate a first position during the movement of the moveable blade element 24 and the dashed lines illustrate a second position of the moveable blade element 24 during the described eccentric movement.

It is to be noted that also two guiding bearings 44 would be sufficient to guide the moveable blade element 24 during its eccentric movement. However, a third guiding bearing as it is provided according to this example increases the mechanical stability during the movement.

Due to the above-described eccentric movement, the movement of the moveable blade element 24 is the same at all sides of the cutting assembly 14. Since the stationary cutting edge 26 and the moveable cutting edge 28 are both circumferentially arranged along the entire periphery of the two blade elements 22, 24, all lateral sides of the cutting assembly 14 may be used for hair trimming. In other words, hair may be trimmed with each of the different peripheral sections of the cutting assembly 14. It is evident that this only becomes possible due to the above-explained eccentric circular movement of the moveable blade element 24.

Figure 8:
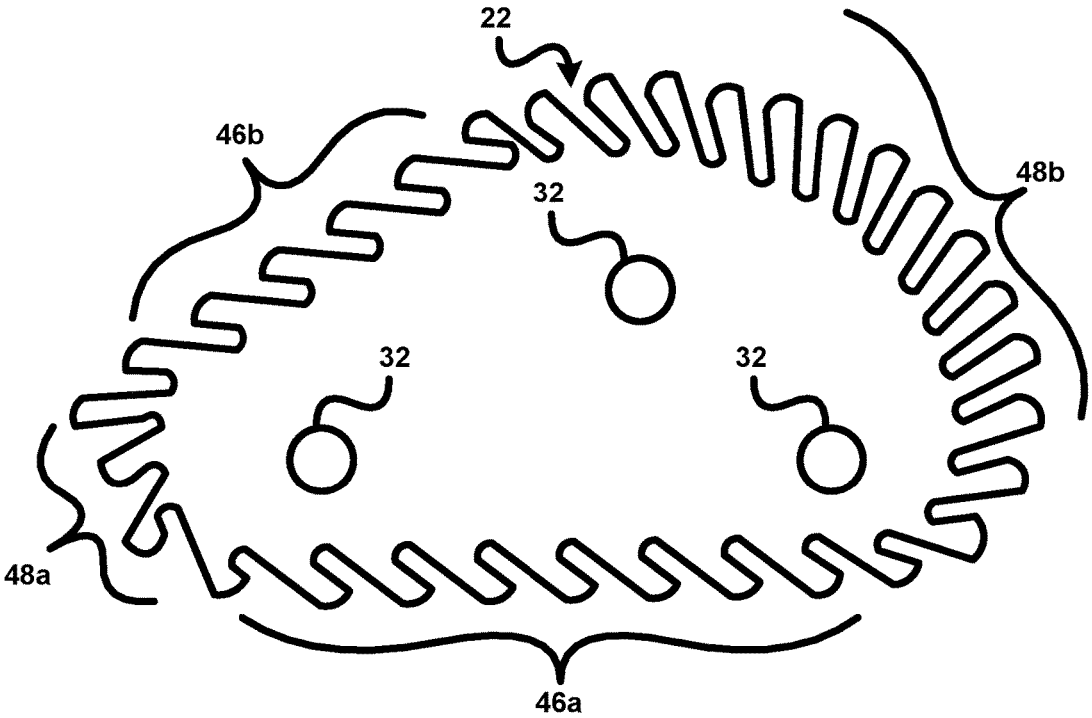
FIG. 8 schematically illustrates the constructive technical details of the stationary blade element illustrated in FIG. 4.
Figure 9:
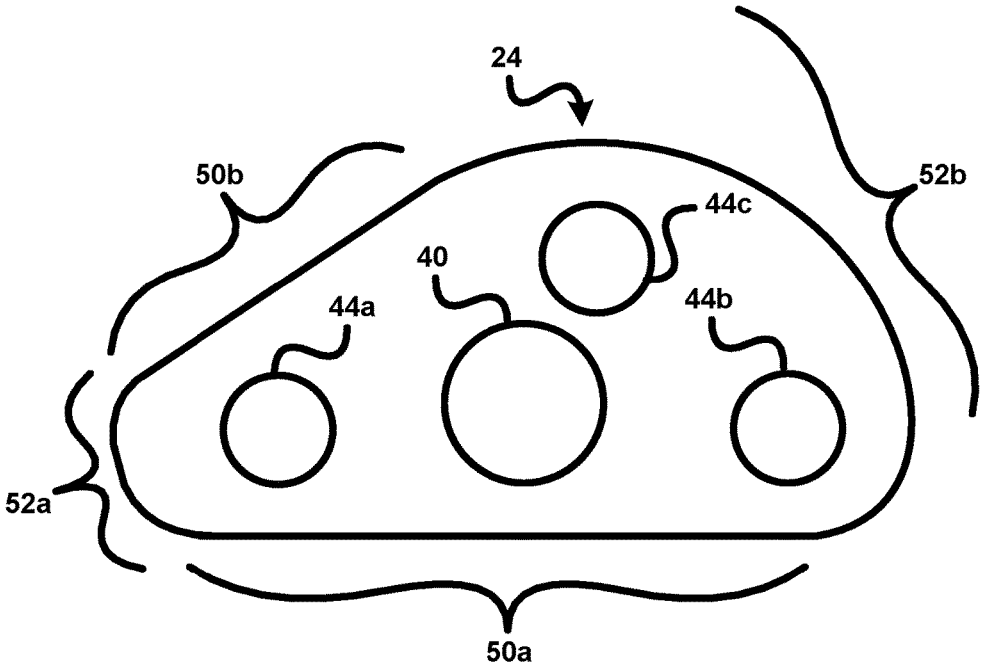
FIG. 9 schematically illustrates the constructive technical details of the mobile blade element illustrated in FIG. 4.

Due to the special construction of the hair clipping device 10, almost every shape of blade element 22, 24 can be realized. In the embodiment shown in FIG. 1-4, the stationary blade element 22 and the moveable blade element 24 have the form of a drop, i.e. they are drop-shaped. This drop shape combines sections of larger straight-lined cutting edges with sections of smaller curved cutting edges that may be used for different kinds of hair cutting contours. In detail as shown in FIGS. 4 and 8, the circumferentially arranged toothed cutting edge 26 of the stationary blade 22 comprises a first straight-lined segment 46*a* of teeth in a straight alignment that passes into a first curved segment 48*a* of teeth in a curved alignment. The first curved segment 48*a* again passes into a third straight-lined segment 46*b* of teeth in a straight alignment and this third straight-lined segment 46*b* of the toothed cutting edge 26 passes into a third curved segment 48*b* of teeth in a curved alignment, which is also connected to the first straight-lined segment 46*a*. As the moveable blade element 24 has substantially the same form as shown in FIGS. 4 and 9, it comprises along its periphery (along the circumferentially arranged second cutting edge 28) a second straight-lined segment 50*a* of teeth in a straight alignment, which passes into a second curved segment 52*a* of teeth in a curved alignment. This second curved segment 52*a* is connected to a fourth straight-lined segment 50*b* of teeth in a straight alignment that passes into a fourth curved segment 52*b* of teeth in a straight alignment. It is to be noted that the terms "first", "second", "third" and "fourth" are only used to differentiate between the different sections 46*a,b*, 48*a,b*, 50*a,b* and 52*a,b* of the two cutting edges 26, 28.

As can be seen in FIG. 4, the first straight-lined segment 46*a* of the toothed cutting edge 26 is longer than the third straight-lined segment 46*b*. Similarly, the second straight-lined segment 50*a* is also longer than the fourth straight-lined segment 50*b* of the second cutting edge 28. Further, the first curved segment 48*a* has a shorter arc length than the third curved segment 48*b*. Accordingly, the second curved segment 52*a* of cutting edge 28 also has a shorter arc length than the fourth curved segment 52*b*.

In order to realize a similar or the same cutting performance on each side of the cutting assembly 14, straight-lined segment 46*a* of cutting edge 26 is preferably arranged parallel to straight-lined segment 50*a* of cutting edge 28; straight-lined segment 46*b* of cutting edge 26 is arranged parallel to straight-lined segment 50*b* of cutting edge 28; curved segment 48*a* of cutting edge 26 is arranged parallel to curved segment 52*a* of cutting edge 28; and curved segment 48*b* of cutting edge 26 is arranged parallel to curved segment 52*b* of cutting edge 28.

The proposed drop-shaped form of the cutting assembly 14 therefore allows to cut different hair contours with one and the same cutting assembly 14. The tip of the drop (segments 48*a*, 52*a*) may be used for fine and thin hair contours, whereas the long straight sides of the cutting edges 26, 28 (segments 46*a*, 50*a* or 48*b*, 50*b*) may be used for rough, broad hair cut contours. As the straight-lined cutting edge segments 46*a*, 50*a* are longer than cutting edge segments 46*b*, 50*b*, the user may even choose between differently broad straight hair cut contours. In order to change or select different hair cut contours, the user only needs to turn the device 10 and contacts the skin with the teeth of the desired section 46*a,b*, 48*a,b* of the toothed cutting edge 26.

Figure 6A:
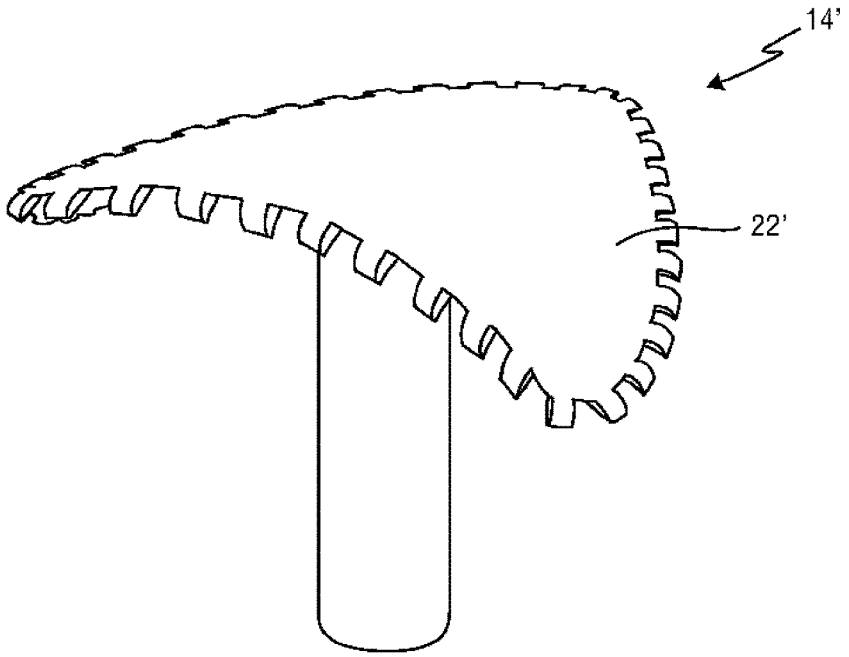
Figure 6B:
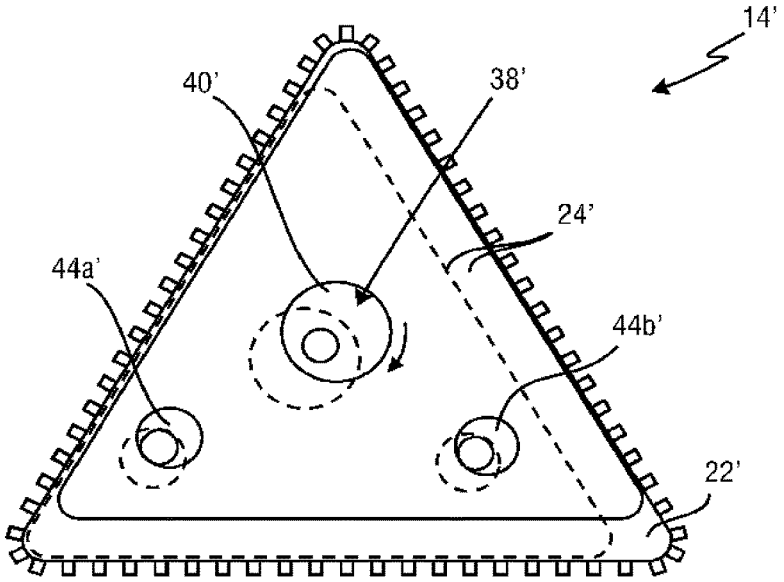
Figure 7A:
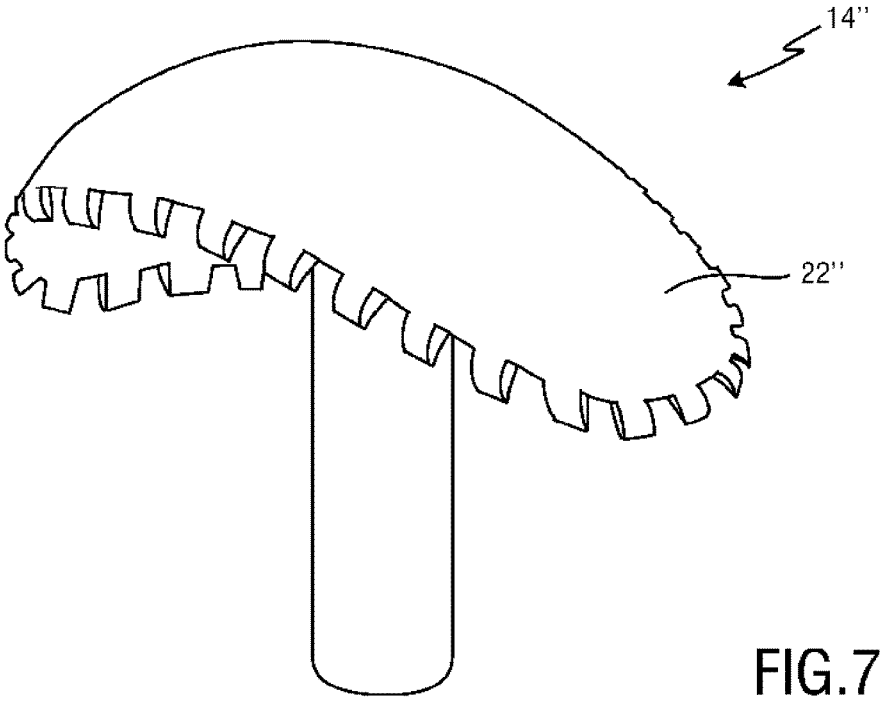
FIG. 7 shows a third embodiment of the cutting assembly of the hair clipping device according to the present invention in a perspective view (FIG. 7*a*) and a schematic view (FIG. 7*b*) from below.
Figure 7B:
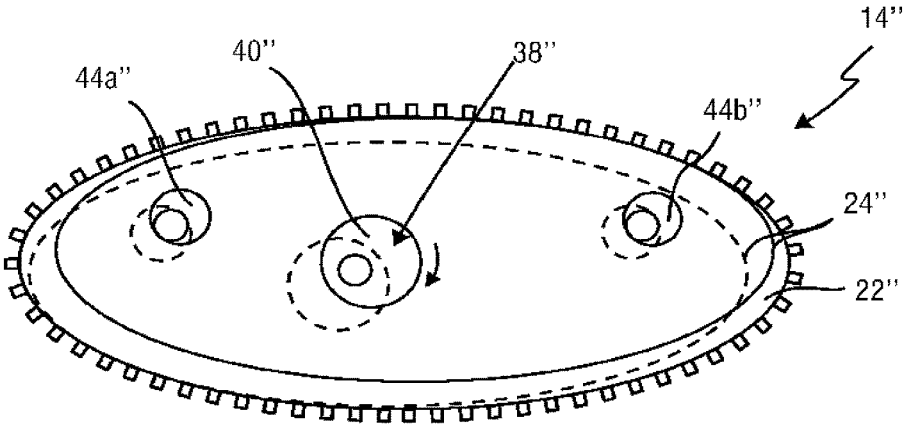

Due to the above-described circular eccentric movement of the moveable blade element 24 with respect to the teeth of the stationary blade element 22 that is used according to the present invention, any arbitrary blade shape can be realized. This gives an enormous freedom of design. The embodiment shown in FIGS. 1-4 comprises a planar, two-dimensional form of the stationary blade element 22 and the moveable blade element 24, respectively. Using the same eccentric driving principle, it is also possible to realize a truly three-dimensional blade shape. Examples of such cutting assemblies 14', 14" with a non-planar, three-dimensional shape of the blades are shown in FIGS. 6 and 7. In both exemplary shown cases, the stationary blade element 22', 22" may, for example, comprise spherically curved plane elements. Similarly, the moveable blade element 24', 24" also comprises three-dimensionally shaped spherically curved plane elements. This of course results in a much more complex form of the blade elements 22', 22" and 24', 24". However, the technical driving principle still remains the same as this is illustrated in FIGS. 6*b* and 7*b* which illustrate the eccentric driving principle of the cutting assembly 14', 14" in a schematical way (similar as illustrated in FIG. 4 for the first embodiment).

The cutting assembly 14' shown in FIG. 6 has more or less a triangular form when seen in a top view (see FIG. 6*b*). In the alternative embodiment shown in FIG. 7, the cutting assembly 14" has more or less the shape of an oval or an ellipse when seen in a top view (see FIG. 7*b*). The eccentric movement principle of the moveable blade element 24', 24" relative to the teeth of the stationary blade element 22', 22" however remains the same as explained before. Each cutting assembly 14', 14" comprises an eccentric coupling mechanism 38', 38" with an eccentric 40', 40" that translates a rotatory movement of the drive shaft 36 into an eccentric movement of the moveable blade element 24', 24". Dashed and continuous lines again illustrate different positions of the moveable blade element 24', 24" during its movement. Different to the first embodiment shown in FIGS. 1-4, the eccentric movement is here only guided with two guiding bearings 44*a*', 44*b*' and 44*a*", 44*b*". However, it is clear that also in this case, three or more guiding bearings 44 may be used to accomplish an eccentric translational movement.

It is to be noted that for a proper operation of the device 10, it is in case of a three-dimensionally shaped cutting assembly 14', 14" essential that the spherically curved plane elements of the stationary blade 22', 22" and the spherically curved plane elements of the moveable blade element 24', 24" have an identical radius of curvature, since the above-described eccentric circular movement may otherwise not be accomplished. However, one can also see that with the technical principle (eccentric driving principle and circumferentially arranged cutting edges) a variety of other two-dimensional and three-dimensional blade shapes are possible to achieve that are not all shown herein. Rectangular or quadratic shapes are of course also possible. The advantage of this freedom of shape offers the possibility to make the special functions directly visible to the consumer. Depending on the different hair cutting appliances, the user may thus choose between a variety of differently shaped cutting assemblies.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. Hair clipping device, comprising:

a housing including a motor for driving a drive shaft in a rotary manner;

a cutting assembly including a stationary blade element having a toothed cutting edge circumferentially arranged on a periphery of the stationary blade element, and a moveable blade element having a second cutting edge circumferentially arranged on a periphery of the moveable blade element;

wherein the drive shaft is coupled to the moveable blade element via an eccentric coupling mechanism that translates a rotary movement of the drive shaft into an eccentric movement of the moveable blade element relative to the stationary blade element;

wherein a portion of the toothed cutting edge is arranged in a first straight-lined segment of teeth in a straight alignment and a first curved segment of teeth in a curved alignment;

wherein a portion of the second cutting edge has a second straight-lined segment and a second curved segment;

wherein the second straight-lined segment is arranged to traverse the teeth of the first straight-lined segment responsive to the eccentric movement of the movable blade, and wherein the second curved segment is arranged to traverse the teeth of the first curved segment responsive to the eccentric movement of the movable blade.

2. Hair clipping device according to claim 1, wherein the eccentric movement of the moveable blade element is an eccentric translational movement.

3. Hair clipping device according to claim 1, wherein the stationary blade element is larger than the moveable blade element.

4. Hair clipping device according to claim 1, wherein the stationary blade element and the moveable blade element have a same form.

5. Hair clipping device according to claim 1, wherein the stationary blade element and the moveable blade element have a drop-shaped form.

6. Hair clipping device according to claim 1, wherein the stationary blade element and the moveable blade element are parallel.

7. Hair clipping device according to claim 1, wherein another portion of the toothed cutting edge further has is arranged in a third straight-lined segment of teeth in a straight alignment and a third curved segment of teeth in a curved alignment, and wherein another portion of the second cutting edge has a fourth straight-lined segment and a fourth curved segment, wherein the fourth straight-lined segment is arranged to traverse the teeth of the third straight-lined segment responsive to the eccentric movement of the movable blade; and wherein the fourth curved segment is arranged to traverse the teeth of the third curved segment responsive to the eccentric movement of the movable blade.

8. Hair clipping device according to claim 7, wherein the first straight-lined segment has a different length than the third straight-lined segment, wherein the second straight-lined segment has a different length than the fourth straight-lined segment, wherein the first curved segment has a different arc length than the third curved segment, and wherein the second curved segment has a different arc length than the fourth curved segment.

9. Hair clipping device according to claim 1, wherein the drive shaft extends along a first direction, wherein the first straight-lined segment, the third straight-lined segment, the first curved segment and the third curved segment are arranged in a first blade plane, which is oriented perpendicular to the first direction, and wherein the second straight-lined segment, the fourth straight-lined segment, the second curved segment and the fourth curved segment are arranged in a second blade plane parallel to the first blade plane, which is also oriented perpendicular to the first direction.

10. Hair clipping device according to claim 1, wherein the second cutting edge is a toothed cutting edge.

11. Hair clipping device according to claim 1, wherein the stationary blade element and the moveable blade element have a non-planar, three-dimensional form.

12. Hair clipping device according to claim 11, wherein the stationary blade element and the moveable blade element each comprise at least one spherically curved plane element.

13. Hair clipping device according to claim 12, wherein the at least one spherically curved plane element of the stationary blade element and the at least one spherically curved plane element of the moveable blade element have an identical radius of curvature.

14. A cutting assembly for use in a hair clipping device according to claim 1, comprising:

a stationary blade element having a toothed cutting edge circumferentially arranged on a periphery of the stationary blade element, wherein a portion of the toothed cutting edge is arranged in a first straight-lined segement of teeth in a straight alignment and a first curved segement of teeth in a curved alignment, and;

a moveable blade element having a second cutting edge circumferentially arranged on a periphery of the moveable blade element;

wherein a portion of the second cutting edge has a second straight-lined segment and a second curved segment;

wherein the second straight-lined segment is arranged to traverse the teeth of the first straight-lined segment responsive to the eccentric movement of the movable blade, and wherein the second curved segment is arranged to traverse the teeth of the first curved segment responsive to the eccentric movement of the movable blade; and an eccentric coupling mechanism, wherein the eccentric coupling mechanism is connected to the moveable blade element and can be coupled to a rotatory driven drive shaft, and wherein the eccentric coupling mechanism is further adapted to translate a rotary movement of the drive shaft into an eccentric movement of the moveable blade element relative to the stationary blade element.

15. Cutting assembly according to claim 14, wherein the stationary blade element is larger than the moveable blade element.

16. Cutting assembly according to claim 14, wherein the stationary blade element and the moveable blade element have a same form.

17. Cutting assembly according to claim 14, wherein the stationary blade element and the moveable blade element have a drop-shaped form.

18. Cutting assembly according to claim 14, wherein the second cutting edge is a toothed cutting edge.

19. Cutting assembly according to claim 14, wherein the stationary blade element and the moveable blade element each comprise at least one spherically curved plane element.

20. Cutting assembly according to claim 14, wherein another portion of the toothed cutting edge further has is arranged in a third straight-lined segment of teeth in a straight alignment and a third curved segment of teeth in a curved alignment;

wherein another portion of the second cutting edge has a fourth straight-lined segment and a fourth curved segment;

wherein the fourth straight-lined segment is arranged to traverse the teeth of the third straight-lined segment responsive to the eccentric movement of the movable blade; and wherein the fourth curved segment is arranged to traverse the teeth of the third curved segment responsive to the eccentric movement of the movable blade.

* * * * *